United States Patent [19]

Beery

[11] Patent Number: 4,928,947

[45] Date of Patent: May 29, 1990

[54] SHEET FEEDERS FOR SOFT COATED SHEET MATERIAL

[75] Inventor: Jack Beery, Centerville, Ohio

[73] Assignee: The Mead Corporation, Dayton, Ohio

[21] Appl. No.: 271,485

[22] Filed: Nov. 17, 1988

Related U.S. Application Data

[63] Continuation-in-part of Ser. No. 125,841, Nov. 27, 1987, abandoned.

[51] Int. Cl.[5] ..... B65H 3/02

[52] U.S. Cl. ..... 271/24; 271/42

[58] Field of Search ..... 271/19, 20, 24, 25, 271/42

[56] References Cited

U.S. PATENT DOCUMENTS

| | | | |
|---|---|---|---|
| 640,368 | 2/1900 | Cross . | |
| 1,003,558 | 9/1911 | Welsh | 271/24 |
| 1,511,714 | 10/1924 | Beadle . | |
| 1,843,118 | 2/1932 | Brasseur . | |
| 1,964,498 | 6/1934 | Brasseur . | |
| 2,042,734 | 6/1936 | Roy . | |
| 2,289,501 | 7/1942 | Kauffeld . | |
| 3,276,770 | 10/1966 | Griswold | 271/19 X |
| 3,447,799 | 6/1969 | Bishop . | |
| 3,601,389 | 8/1971 | Kramer . | |
| 3,713,645 | 1/1973 | Ferrari et al. . | |
| 3,773,316 | 11/1973 | Stemmle . | |
| 3,809,388 | 5/1974 | Downing | 271/20 |
| 3,989,237 | 11/1976 | Goff, Jr. et al. . | |
| 4,192,498 | 3/1980 | Toto . | |
| 4,223,884 | 9/1980 | Burnham et al. . | |
| 4,227,687 | 10/1980 | Schoonmade . | |
| 4,269,404 | 5/1981 | Webb . | |
| 4,281,829 | 8/1981 | Thomas . | |
| 4,394,010 | 7/1983 | Hogenson . | |
| 4,418,903 | 12/1983 | Landa . | |

FOREIGN PATENT DOCUMENTS

| | | | |
|---|---|---|---|
| 481409 | 8/1929 | Fed. Rep. of Germany | 271/19 |
| 1244405 | 2/1969 | United Kingdom . | |

*Primary Examiner*—Richard A. Schacher

*Attorney, Agent, or Firm*—Biebel, French & Nauman

[57] ABSTRACT

A sheet-feed mechanism for feeding paper or the like from a stack of paper sheets in a tray in which the sheets have a soft or pressure-sensitive coating, includes a sheet-engaging apparatus which distributes the load over a substantial area of the sheet, in order to control the pressure on the sheet. Simultaneously, the apparatus is moved in a direction to cause buckling of the exposed or first sheet, for separation from the stack and subsequent removal. Two embodiments are disclosed. One embodiment employs a pair of feed wheels and another embodiment employs a sheet-engaging flat pad. The wide feed wheels or the pad are caused to be moved, following engagement with the exposed sheet, in a direction generally parallel to the plane of the sheet, for causing the separation of the sheet. In this manner, the loading imprint is not confined to a specific area, with respect to the underlying sheets, thereby preventing pressure marking or scuffing of the sheet immediately under the first sheet removed by the feed mechanism.

2 Claims, 2 Drawing Sheets

FIG-4
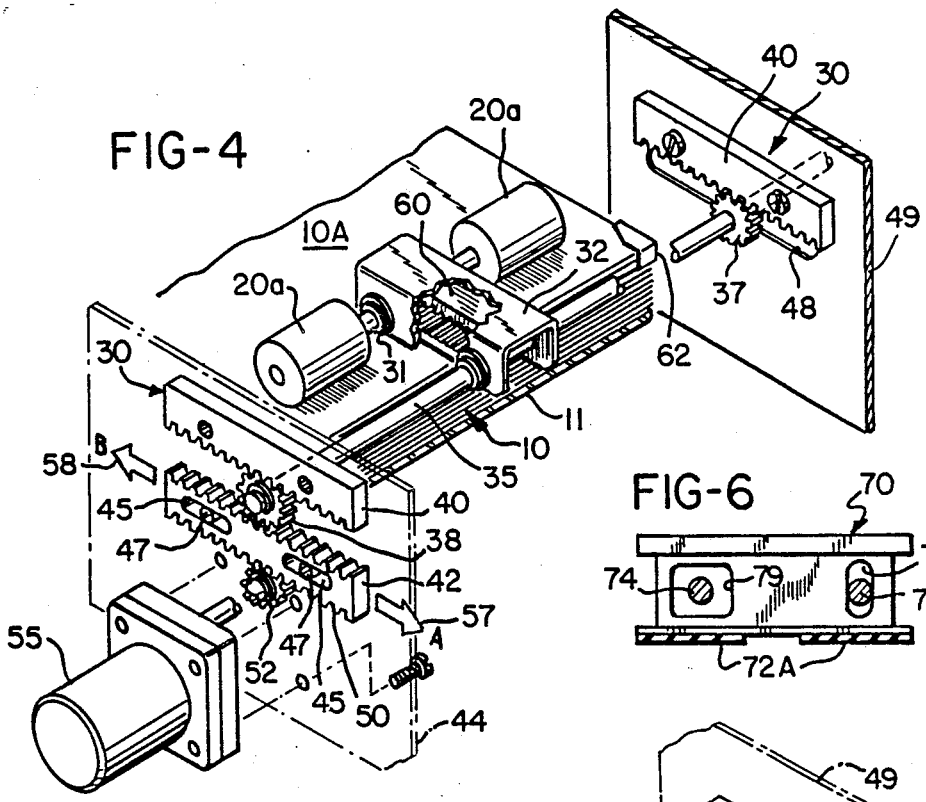
FIG-6
FIG-5
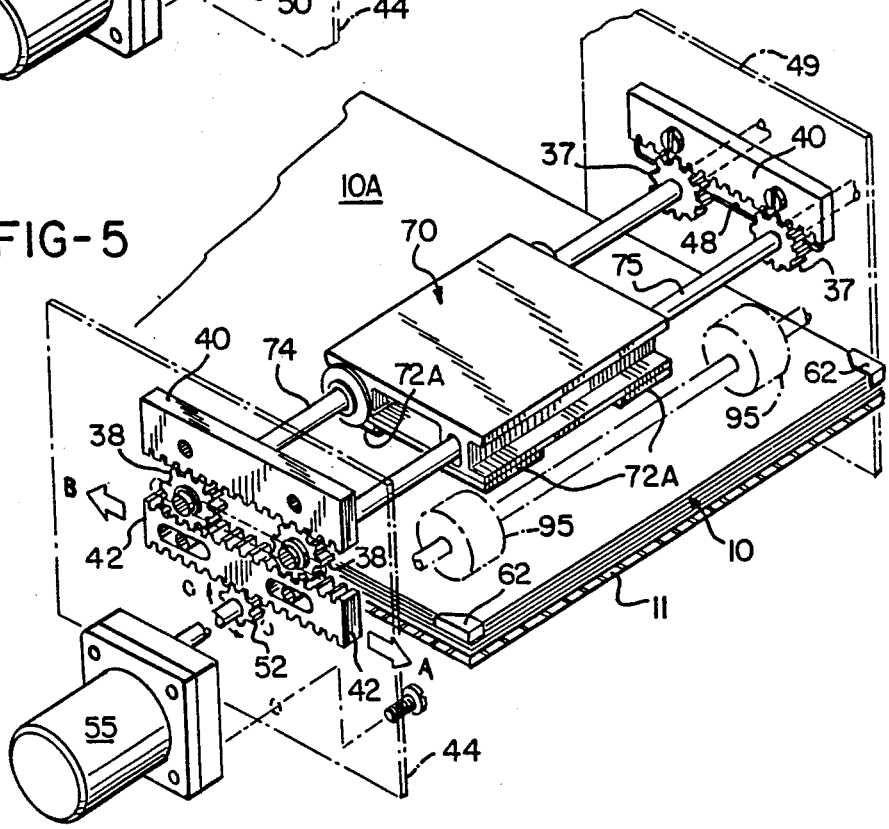

SHEET FEEDERS FOR SOFT COATED SHEET MATERIAL

RELATED APPLICATION

This application is a continuation-in-part of application Ser. No. 125,841 filed Nov. 27, 1987, now abandoned.

BACKGROUND OF THE INVENTION

Sheet or paper feed mechanisms for feeding the first sheet from a stack of sheets commonly employ feed wheels. These wheels move into engagement with the exposed sheet, to cause the separating and feeding of the sheet, usually by an initial buckling movement of the sheet, followed by the release of the sheet from the stack so that the sheet may be fed through take-away rolls from the stack. Both forward and reverse buckling concepts have been employed. In either case, the feed wheels usually remain at a fixed location in relation to the stack, during sheet feeding.

A particular problem arises in the feeding of paper from a stack, in which the paper has a soft coating or is otherwise sensitive to pressure. An example of sheets having a soft coating, which may be easily damaged by excessive localized pressure, are the receiver sheets disclosed and described in U.S. Pat. No. 4,399,209 assigned to the same assignee as this invention. The feeding of such sheets is complicated by the tendency for the mechanical locking between the adjacent sheets, due to the relatively high co-efficient of friction of the sheet surfaces.

In such systems, the feed wheels create a pressure on the second sheet (n+1) at a location directly under the feed wheels, which pressure can cause damage such as skid marks on the second sheet, since this sheet remains stationary in relation to the feed wheels while the first sheet is moved. The first sheet damages the second sheet by skidding over one location while under pressure from the feed wheels.

Previous attempts to reduce the problem have involved the positioning of the take-away rolls so that the dispensed sheet is removed immediately after feeding by the fixed feed wheels. However, with a distance as short as one inch, damage has been observed on the second or underlying sheet.

Additional attempts to control pressure and to provide a non-marking feed construction have involved the use of relatively thick foam rubber pads on a top sheet contacting member. By relatively thick, it is meant that the aspect ratio of the pads, thickness to length in the process direction, was from about 1 to 1 to 3 to 1. Such thick pad contacting devices proved to be unsatisfactory for the feeding of soft coated and pressure sensitive media material of the type defined above, primarily in view of the tendency of the material to roll or tilt, or pitch. In such devices, the tendency is for the leading or forward edge to pitch against the sheet being processed with concomitant lifting of the rear or trailing edge, due to the lack of rigidity of such blocks in the process direction.

SUMMARY OF THE INVENTION

This invention provides a sheet feed apparatus which solves the problem of existing feeders with respect to the marking of second sheets, by controlling the force/-time relationship of the sheet contacting member in relation to the first sheet. In one embodiment of the invention, a relatively low contact force is applied to a contact member in the form of relatively wide contact wheel or wheels, and the contact member is simultaneously moved in relation to the stack so that the force which is applied at any one location is of a short duration.

In a preferred embodiment of this invention, a very low force contact member is provided by a pad or shoe which distributes the contact force over a substantial area of the top sheet. One or more contacting pads are employed which are relatively rigid in the process direction, and preferably take the form of pads of thin rubber of a composition similar to a natural rubber or a silicone rubber. The pads are substantially longer than they are thick, and have an aspect ratio of length to thickness in the order of 10 to 1 up to 20 to 1 or more.

Accordingly, the contacting pad may consist of a plurality of individually and commonly support pad sections or portions which, together, define coplanar sheet-contacting surfaces. Such surfaces provide a very low sheet contacting unit pressure, but maintain rigidity in the process direction, with no tendency to pitch, tip or roll at the leading edges.

The member which comes into contact with the first sheet, after such contact, is moved in the process direction in a plane generally parallel to that of the sheet. In a top dispensing or top feeding apparatus, the exposed sheet will be the top sheet in the tray. The pressure/time relationship of the sheet-engaging and moving apparatus is controlled so as to minimize and eliminate scuffing and marking of soft-coated and/or pressure sensitive sheet material.

It is accordingly an important object of this invention to provide a sheet feed mechanism particularly adapted for the feeding of soft coated sheet material, or pressure sensitive sheet material, or the like.

A further object of the invention is the provision of a dispensing paper feeder, particularly adapted for the feeding of paper having a soft or easily marked coating thereon, in a buckling type of feed mechanism, in which the feed pressure is distributed over a relatively wide area, and in which the feed pressure area is moved, during the feeding of the exposed sheet, in relation to the position of the second and subsequent sheets.

A still further object of the invention is the provision of a sheet feeder in which the sheets are top fed from a tray or stack of such sheets, to cause buckling of the first sheet followed by delivery thereof in the process direction, while maintaining a contact pressure which is sufficiently low in duration and/or degree to cause scuffing or marking of the second sheet.

Another object of this invention is the provision of a sheet feed mechanism including one or more rubber contacting pads which have a substantial area to provide a very low unit pressure and which are relatively rigid in the process direction. Where a plurality of individual pad or pad portions are employed, the bottom or lower sheet engaging surfaces are in a common plane.

These and other objects and advantages of the invention will be apparent from the following description, the accompanying drawings, and the appended claims.

BRIEF DESCRIPTION OF THE DRAWINGS

FIG. 4 is a perspective view, with parts being broken away to assist in illustrating a mechanism according to the embodiment of the invention as shown in FIG. 2;

FIG. 5 is a view similar to FIG. 4, showing a mechanism according to the embodiment of the invention as shown in FIG. 3; and FIG. 6 is a side elevation of the sheet-engaging shoe member of FIG. 5 showing the support shafts in section.

DETAILED DESCRIPTION OF THE PREFERRED EMBODIMENTS

Figure 1:
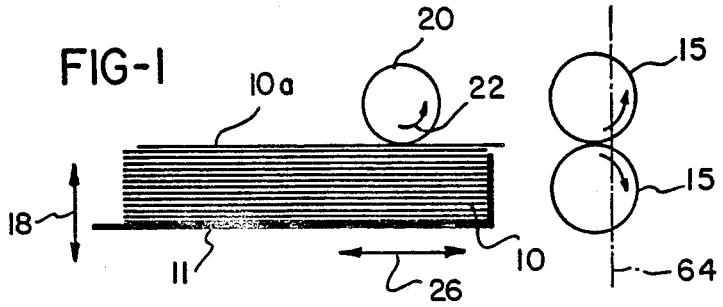
FIG. 1 is a diagrammatic representation of a paper sheet feed mechanism in accordance with this invention.

The drawings illustrate preferred embodiments of the invention as applied to a forward, buckling-type of top feed or top delivery sheet paper feed mechanism. Thus, while the preferred embodiments are described in connection with a top feed, foward-buckling feeder, it will be understood that the principles involved herein may be applied to a top feed, rear-buckling or reverse-buckling type of sheet feeder mechanism, and may also be applied to a bottom-feed type of delivery or feed mechanism.

In such a top delivery or top-feed mechanism, the stack 10 of sheets, which may be sheets of paper, are received in an elevating tray 11, and the top sheet 10*a* is separated by the mechanism of this invention from the stack to the nip of a pair of adjacent take-away rollers 15. Preferably, these rollers are adjusted to rotate at about the same peripheral velocity as the linear velocity of sheet 10*a* from the stack. For tolerance purposes, the rollers 15 may rotate slightly slower than the linear velocity of the dispensed sheet 10*a* since this sheet is under control of the paper feed mechansim and it is undesirable to apply a tension to the paper by the take-away rollers which would tend to pull the paper out of control or away from the delivery mechanism during the initial stages or delivery.

Snubbing and sheet delivery apparatus of conventional construction is shown, for example, in U.S. Pat. No. 3,713,645 issued Jan. 30, 1978, in which a feed wheel causes the top sheet in a tray to be buckled forwardly against a snubber for separation from the second and subsequent sheets in the stack of sheets. The top sheet is forward fed by frictional engagement with one or more feed wheels in a direction generally parallel to the plane of sheets in the stack, and into the nip of the rollers 15. Such feed wheels, as shown in the above-identified patent, remain at a generally fixed location with respect to the sheet stack. Also, they have a width which is relatively narrow with respect to the width of the sheets, so that the imprint force of the wheels on the stack as the stack is elevated by the tray, or as the delivery wheel mechanism is lowered, always impacts against the stack at the same general location. When soft coated papers are employed, such as a receiver sheets made in accordance with the above-identified U.S. Pat. No. 4,399,209, and when such force exceeds 0.1 psi, skid marks may be formed in the immediate underlying sheet, thereby damaging such sheet.

In accordance with this invention, marking is avoided by increasing the contact areas of the feed device 20 which come into contact with the exposed sheet 10a, and by causing the feed device to move relatively, following contact with the sheet 10*a*, in a direction generally parallel to the plane of this sheet. The feed wheel 20 of FIGS. 1 and 2 does not remain at a location which is fixed with respect to the geometry of the tray 10, but is moved relative to the stack so that its imprint force is distributed with respect to the underlying sheets.

Figure 2:
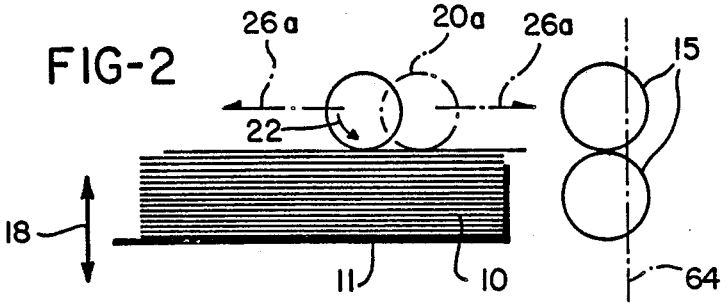
FIG. 2 is a diagrammatic view of a somewhat modified form of the mechanism of FIG. 1.

In the embodiment of the invention as shown diagrammatically in FIGS. 1 and 2, the tray 11 is movable in the direction of the arrows 18 between a lowered and an elevated position. The feed device or wheel is diagrammatically represented by a wide paper feed wheel 20 or 20*a* (FIG. 2) which is driven counterclockwise in the direction of the arrow 22 as in a conventional forward-buckling sheet feed device. However, and in addition, either the tray 11 (FIG. 1) or the feed wheel 20*a* (FIG. 2) is bi-directionally driven such that a relative motion occurs parallel to the plane of the top sheet 10*a* simultaneously with the delivery, and in an additive manner, in the direction of the delivery.

In the embodiment diagrammed in FIG. 1, a bi-directional tray drive moves the tray 10 in the direction of the arrow 26. Alternatively, as shown in FIG. 2, a bi-directional drive is used to move the feed wheel 20*a* in the direction of the arrows 26*a* (FIG. 2) while the tray 11 remains stationary. As indicated above, the feed wheel 20 or 20*a* has a substantial width compared to the transverse width of the sheets 10, so that the pressure imprint is held to a practical minimum, such as 0.04 psi or less.

FIG. 4 illustrates a preferred bi-directional drive mechanism for moving the wheels 20*a* in the direction of arrow 26 in FIG. 2, and a mechanism for driving the wheels in the direction of the arrow 22. In FIG. 4 a rack and pinion type translational drive 30 moves the feed wheels transversely and in an direction generally parallel to a plane which includes the top sheet 10a on the stack 10 of sheets simultaneously with the separation of the top sheet 10*a* from the stack. In this manner a fixed skid imprint location with respect to the stack is avoided.

Two wide paper feed wheels 20*a* are mounted on a common drive shaft 31. The shaft 31 is received in a drive shaft support housing 32. As shown, the wheels 20*a* each have a relatively wide imprint, approximately equal to about one-fourth the width of the sheets 10 in the tray 11. In a feeder for 8.5" wide paper, the wheels may be approximately $2\frac{3}{4}$ wide.

The housing 32 is, in turn, mounted on a generally transversely-extending support or driver rod 35, the ends of which terminate at spur gears 37 and 38. The spur gear 38 is mounted between a pair of opposed racks 40 and 42. The top rack 40 is fixed to a side wall 44 while the lower rack 42 is provided with slotted openings 45. The openings 45 receive fixed support mounts 47 on the wall 44 for low-friction sliding movement thereon.

The remote end of the driver rod 35 extends through a slot 48 in the opposite side wall 49 and runs on a single top rack 40. The end of the rod 35 extending through the slot 48 supports a clip (not shown) to prevent excessive endwise movement of the rod 35.

The lower rack 42 is formed with bottom driven teeth 50 in engagement with a spur gear 52 of a motor 55, to provide for forward and reverse reciprocating movement of the rack 42. This is translated into rotational movement of the spur gears 37 and 38 to provide for translational movement in the direction of arrow 57 in a forward buckling and sheet delivery direction, and reverse movement in the direction of arrow 58 to a starting position of the mechanism. Advantageously, the rotation of the spur gears by the translational movement of the double-sided rack 42 causes a concurrent rotation of the support rod 35. This rotation is translated to the wheels 20*a* through a cog belt 60 within the housing 32. The direction of feed is in the direction of arrow 57 against the corner snubbers 62 for lifting of the top sheet 10*a* of the stack and for delivery to the feed rollers 15 (FIG. 2).

The operation of the sheet-feed mechanism may be understood by reference to FIGS. 1 and 2 in which the bi-directional drive, at the start, moves to place the paper feed wheels 20 or 20a at the left-hand or home position in relation to the feeding end of the tray 10. The feed wheels are lowered, or alternatively, the tray 10 is elevated to bring the wheels into contact with the exposed upper sheet 10*a*.

The drive, such as the motor 55, is operated to begin the relative movement of the bi-directional drive, to bring the feed wheels 20 or 20*a* to the right of FIGS. 1 or 2 relative to the tray, and at the same time the feed wheels are turned in the direction of the arrow 22 (FIG. 1). The sheet 10*a* may thus be separated from the stack and moved into the nip between the rollers 15 to a sensor position 64 just beyond the nip. A sensor may be employed at this point to terminate the bi-directional drive and the concurrent rotation of the rolls, and the elevator supporting the tray 10 may be lowered to clear the stack of sheets from the feed wheels.

Figure 3:
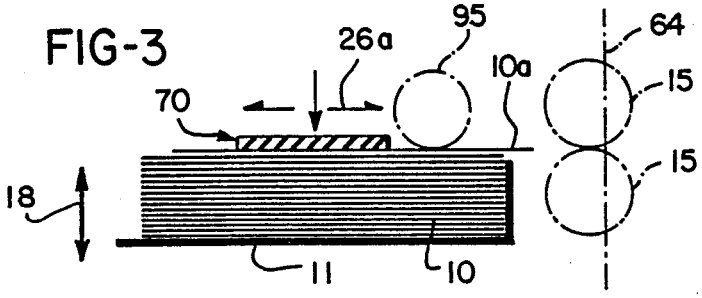
FIG. 3 is a diagrammatic view of another embodiment of a sheet feed mechanism in accordance with this invention.

The second preferred embodiment, as shown in FIGS. 3 and 5, employs a feed device which includes a generally rectangular pad shoe or support 70. The support 70 is formed with a lower sheet-engaging surface 72 of rubber. The surface 72 may consist of a single pad or a plurality of co-planar pads which have lower surfaces in a common plane for engagement with the upper sheet 10a of the tray 11 when the tray 11 is elevated to the raised position. In the elevated or raised position, the weight of the pad support 70 bears on the upper sheet, and the position of the support 70 is controlled by the shafts 74 and 75. As shown in FIG. 6, the shaft 75 passes through a narrow vertical front slot 76, but does not touch the top or bottom of this slot.

However, there is a close fit between the shaft 75 and the parallel sides of the slot 76, so that the shaft acts as a driver for the pad support 60. The back shaft 74 passes through a clearance 79 in the pad support 70.

Each of the shafts 74 and 75 terminate in spur gears 37, 38 and are driven in the manner previously described in connection with the driver rod 35. The clearance opening 79 and the slot 76 assures that there is no binding between the pad support 70 and the shafts.

When the tray 11 is lowered, the support 70 rests on top of the shafts 74 and 75, allowing the paper to move easily from beneath. At the same time, the pad support 70 will be moved to the rearward or home position. Then, when the tray 11 is elevated or lifted, only the weight of the pad support 70 will be on the paper. Accordingly, the unit pressure over the surfaces defined by the pad or pads 72, carried by the support 70, is a function of the weight of the support 70 and the area defined by the engaging surfaces 72.

The transport mechanism of FIG. 5 may be used with a conventional paper feed roll 95 which is diagrammatically illustrated in FIG. 3 and shown only in phantom in FIG. 5. The conventional feed roll 95 need not be in physical or pressure contact with the upper sheet 10 on the stack, but may be spaced slightly above the top sheet and may be free-turning to provide a desired buckle geometry to the paper in relation to the forward corner snubbers 62. For example, if such a roll is used, it may be positioned to clear the top sheet by 0.020".

The bottom sheet-engaging surface of the pad is positioned in a plane which is generally parallel to a plane including the stack 10 and the top sheet 10*a*, and may form the surface of a relatively high friction elastomer material such as natural rubber or silicone. A pad 72 may, advantageously, be in the form of one or more individual pad sections 72*a* a and, for example, four such pad sections may be employed on the lower surface of the pad support 70. When four pads are used, they may have a total of 5.2 square inches. When the pad support 70 weights 8.5 ounces, a pressure of 0.1 psi is applied to the sheet 10*a* when the weight of the pad support 70 rests on the stack 10. However, it is within the scope of this invention to increase this area, as may be desired or required, to prevent marking by scuffing. The pad sections 72*a* have coplanar bottom sheet-engaging surfaces and are relatively thin, compared to the length of the pad sections in the process direction, and may have an aspect ratio of from approximately 10 to 1 length/thickness up to 20 to 1 length/thickness or more. Such relatively thin pad sections provide the necessary ridigity in the process direction in that the pads do not have any tendency to pitch or tilt with respect to the pad support and the top sheet 10*a*. Accordingly, the pressure exerted by the pad section 72*a* remains relatively uniform during sheet delivery.

The operation of the embodiment as shown in FIGS. 3, 5 and 6 is in many respects the same as that previously described. When the tray 11 is elevated, the upper sheet will come into contact with the friction pad sections 72*a* on the lower surface of the pad support 70 and will lift the pad support substantially to the position as shown in FIG. 6. The operation of the motor 55 will cause movement of the shaft 75 and therefore movement of the pad support 7 in the lead or process direction 57, causing movement of the pad support in the direction of the arrow 26*a* of FIG. 3 for dispensing the sheet 10*a* from the stack. As previously mentioned, the free-turning rollers 95 may be used to engage the top sheet for controlling the extent of buckle and for controlling movement of the sheet to the take-away rollers 15. The tray 11 may be lowered and the motor 55 reversed to bring the pad support 70 back to its home or start position in the direction of the arrow 58 of FIGS. 4 and 5.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In a sheet feed mechanism in which single sheets which have a soft of pressure sensitive coating are selectively fed in a feed direction from the top of a tray of such sheets, the improvement to prevent scuffing or marking of the sheet immediately underlying the top sheet being fed, comprising:

sheet feed means positioned adjacent the top of said tray, said sheet feed means including a pad support body, a pad of elastomer material mounted on a bottom surface of said support body, and defining a lower generally planar sheet-engaging surface, said pad being relatively thin and having a length in said feed direction, which is a substantial multiple of the thickness of said pad to provide rigidity of said pad in said feed direction, drive means for said pad support body including a generally vertically oriented slot extending transversely through said body adjacent a leading edge thereof in relation to said feed direction, a drive shaft received in said slot movable against a wall of said slot in said feed direction while permitting the weight of said pad support body to rest on a top sheet in said tray of sheets, and means for moving said shaft in said feed direction against said slot wall to carry said pad support body in said feed direction without inducing any substantial tipping force on said pad.

2. The sheet feed mechanism of claim 1 in which said paid has a length in said feed direction which is about 10 to 20 times the thickness thereof.

* * * * *